US006677296B2

(12) United States Patent
Bonsall

(10) Patent No.: US 6,677,296 B2
(45) Date of Patent: Jan. 13, 2004

(54) WASHING TABLETS MARKED WITH INDICIA ON THEIR SURFACES

(75) Inventor: Judith Maria Bonsall, Bebington (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 151 days.

(21) Appl. No.: 09/730,107

(22) Filed: Dec. 5, 2000

(65) Prior Publication Data

US 2001/0009892 A1 Jul. 26, 2001

(30) Foreign Application Priority Data

Dec. 16, 1999 (GB) ..... 9929843

(51) Int. Cl.[7] ..... C11D 17/00
(52) U.S. Cl. ..... 510/446; 510/447; 101/35
(58) Field of Search ..... 510/141, 147, 510/152, 446, 447, 449; 101/35

(56) References Cited

U.S. PATENT DOCUMENTS

| | | | | | |
|---|---|---|---|---|---|
| D138,687 | S | * | 8/1944 | Werner et al. | D73/1 |
| 4,406,364 | A | * | 9/1983 | Bronander, Jr. | 206/77.1 |
| 4,548,825 | A | | 10/1985 | Voss et al. | 426/383 |
| 5,472,545 | A | | 12/1995 | Malki | 156/252 |
| 6,083,895 | A | * | 7/2000 | Warwick | 50/224 |
| 6,184,191 | B1 | * | 2/2001 | Wolfersberger | 510/147 |
| 6,372,707 | B1 | * | 4/2002 | Boskamp et al. | 510/440 |
| 6,486,117 | B1 | * | 11/2002 | Painter et al. | 510/446 |

FOREIGN PATENT DOCUMENTS

| | | |
|---|---|---|
| GB | 2 171 643 | 9/1986 |
| JP | 05/239498 | 9/1993 |
| JP | 06/192696 | 7/1994 |
| WO | 91/01884 | 2/1991 |
| WO | 94/01239 | 1/1994 |
| WO | 97/20028 | 6/1997 |
| WO | 97/48384 | 12/1997 |

OTHER PUBLICATIONS

GB Search Report in a GB application GB 9929843.2.
Derwent Abstract JP 05 0239498—published Sep. 17, 1993.
PCT International Search Report in a PCT application PCT/EP 00/11540.
F. Schambil and M. Bocker, Tenside Surf. Det. 37 (2000) 1 "*Detergent Tabs—One Year After Their Pan–European Launch*."

* cited by examiner

*Primary Examiner*—Necholus Ogden
(74) *Attorney, Agent, or Firm*—Rimma Mitelman

(57) ABSTRACT

Washing tablets of compacted particulate washing composition are marked with indicia on their surfaces, the indicia preferably being of a contrasting color. Processes for applying the markings are also described, as is a combination of the marked tablets with a packaging system.

2 Claims, No Drawings

WASHING TABLETS MARKED WITH INDICIA ON THEIR SURFACES

FIELD OF THE INVENTION

This invention relates to washing tablets marked with indicia on their surfaces and to processes for marking indicia on the surfaces of washing tablets. In addition, this invention relates to the marked tablets in combination with a packaging system.

BACKGROUND OF THE INVENTION

Washing compositions in tablet form (hereinafter referred to as "washing tablets") are made from compacted particulate material. They are used for several applications, including laundry washing, machine dish-washing, toilet hygiene and bathing. Although this invention is primarily directed at laundry and machine dish-wash tablets, it is also applies to other types of washing tablets as will be apparent to the person skilled in the art.

It is very well known to present indicia the surfaces of soap bars by means of an applied label bearing the indicia. However, it is not appropriate to label compacted particulate washing tablets in this way because the label will become detached in the wash cycle and could clog the filter of the machine.

There are a number of options for manufacturing washing compositions, particularly those employed in laundry and machine dish-washing. Such compositions have for many years been manufactured in particulate form, commonly referred to as powders. More recently, washing compositions have also been manufactured as liquids. Tablets, to which this invention relates, are yet another possibility.

Washing tablets have, potentially at least, several advantages over powder and liquid products. They do not require the user to measure out a volume of powder or liquid. Instead, one or more tablets provide an appropriate quantity of the composition for the particular application to which the composition is directed. For example, one or more tablets will provide an appropriate quantity of composition for washing a single load in a laundry or dish-washing machine, or an appropriate quantity of washing composition in a vessel for bathing. Tablets are therefore easier for the consumer to handle and dispense, and being more compact, facilitate more economical storage.

Washing tablets are generally made by compressing or compacting a quantity of the washing composition in particulate form. Materials which specifically aid tablet formation can be added to the washing composition prior to compaction, however such materials are typically added in small amounts and usually account for less than 10%, preferably less than 5% by weight of the tabletted washing composition.

It is desirable that washing tablets should have adequate strength when dry, yet have the appropriate dispersion and dissolution characteristics for the particular function they are to perform. In the case of laundry tablets it is desirable that the tablets disperse and dissolve relatively quickly in the wash water. Generally speaking, washing tablets of the present invention disperse and dissolve significantly quicker that other types of tablets. For example, most pharmaceutical tablets are specifically designed to be delivered orally but not to break up and dissolve in the mouth, i.e. they are designed to dispense and dissolve in the stomach and intestine. For this reason, pharmaceutical tablets have very different physical characteristics from those of washing tablets.

The colour of washing tablets is generally determined by the colour of the particulate ingredients being compacted. For example, coloured specks may be added to a white powder to produce a speckled tablet, or a blue powder may be compacted to produce a blue tablet. In order to obtain a two-coloured "layered" tablet, two separate particulate compositions need to be used. The colour may be the only difference in composition between two layers in a washing tablet. In such a case, "layering" is used for aesthetic reasons and/or to indicate to the consumer that the product performs two particular actions, i.e. it has a "double-action". Clearly, in such cases, it would be advantageous if the tablet could be compacted from a single particulate composition and colour applied to the formed tablet to give the appearance of layering. This would remove the need to have more than one particulate washing composition as starting material.

Manufacturers of washing tablets typically produce several variants of tablets, providing information regarding the particular variant on the tablet packaging. For example, in the case of laundry tablets, details of the brand name and brand type (e.g. non-biological, colour-care etc.) are usually found on the tablet packaging. This means that each tablet variant has to have its own primary packaging appropriately labelled. If tablets were marked with indicia indicating such details as brand name and type, then the need to put this information on the tablet packaging would be negated. Indeed, the same packaging could be used for all the variants. Furthermore, transparent packaging would allow the markings on the tablet to be observed through the packaging. This would offer considerable supply chain advantages, in particular in terms of time and cost savings.

It is known to use ink jet printing to print a picture, patterns and/or characters on a solid bath salt, as disclosed in JP-A-61 092696. However, bath salts do not present the same kind of technical problem for surface marking, as do washing tablets.

To date, the skilled person has not succeeded marking washing tablets on their surfaces, and in particular laundry and machine-dish wash tablets, for a series of reasons. These include the following:

i) Washing tablets are prepared by compaction of relatively large coarse particles. The compaction pressures are relatively low and the material being compacted is primarily washing composition, i.e. no or relatively small amounts of ingredients specifically to aid tablet formation are present. As a result, washing tablets tend to have very rough undulating surfaces which have a tendency to rub off easily. This is one reason why washing tablets are usually packaged individually or in pairs. Furthermore, the "undulations", which to a certain extent are an artefact of the coarseness of the particulate starting material, are large relative to the size of the indicia one might wish to apply.

ii) Washing tablets are often made up of a multitude of components. For example, a laundry tablet may typically comprise surfactants, builders, sequestrants, soil-release agents, bleaches, fluorescers, enzymes, perfumes etc. Such a tablet would be prepared by mixing a number of particulate ingredients together to produce the right formulation and then compacting the resulting particulate mixture. This results in a laundry tablet which differs dramatically in its chemical composition across its surface.

iii) Many washing tablets contain particular chemical components, such as bleaches and dye transfer inhibitors, which could interact with a colourant used to mark the tablet.

iv) Many washing tablets have an alkaline pH, for example in excess of 9 or even 10. Many colourants are pH sensitive.

v) Washing tablets are highly absorbent. This means that most solvents hitting their surface will be absorbed very quickly, which in the case of a colourant, could lead to a chromatography effect and loss of definition. This would be highly undesirable.

vi) There is a need to ensure that any marking applied to the tablets does not compromise the performance of the washing tablet. For example, in the case of a laundry tablet, if a colourant is used to mark indicia on the tablet, this must not soil the clothes.

Surprisingly, in spite of the surface roughness, the surface's tendency to rub off, the high absorbency and the variation in chemical composition that can occur across the surface, we have found it is possible to mark washing tablets with indicia on their surface and that the visibility and definition of the indicia produced are high and remain high for a significant length of time.

Clearly any marking process must not compromise the integrity of the tablets and be amenable to incorporation into a high-speed, automated, continuous production line. However, in order to perform their function properly (i.e. relatively rapid dispersion and dissolution), washing tablets are relatively less compact and less robust than other forms of tablets. Such inherent properties have been a major factor in dissuading research on the feasibility of marking washing tablets with indicia on their surfaces. For example, see points (i) and (v) as discussed above. Thus, conventional techniques used to mark other types of tablets (e.g. pharmaceutical tablets) such as contact printing and engraving were not previously considered suitable for marking washing tablets, in particular because of the lower mechanical strength of washing tablets.

Contrary to the perceived opinion, we have surprisingly found that washing tablets can be successfully marked with indicia, without detriment to the integrity of the tablet, by use of conventional marking techniques such as contact printing. More particularly, we have found that in various embodiments, the invention solves a number of different technical problems, as will be described in more detail hereinbelow. For example, it has been found that non-contact marking techniques, such as, for example, ink-jet printing are particularly advantageous.

PRIOR ART

U.S. Pat. No. 4,548,825 discloses a method for marking tablets with letters or symbols using a ink-jet printing system. WO94/01239 describes a laser drilling process for producing holes in tablets. WO91/01884 describes a process in which tablets are marked by contact printing and then part of the printed mark removed by exposure to a laser. All these documents relate to pharmaceutical tablets. Such tablets are more compact than washing tablets, have much smoother surfaces than washing tablets and have surfaces with a far lower tendency to rub off than washing tablets. In addition, pharmaceutical tablets comprise relatively few components. They mainly comprise "filler" materials selected for their tablet making properties, to which are added relatively small amounts of the pharmaceutical active. Consequently, the chemical variation across the surface of pharmaceutical tablets is far less than that observed in the washing tablets of the present invention.

DEFINITION OF THE INVENTION

In a first aspect, the invention provides a washing tablet of compacted particulate washing composition having indicia on at least one surface thereof.

In a second aspect, the invention provides a process for marking indicia on the surface of a tablet of compacted particulate washing composition, characterised in that the indicia are applied by a contact marking technique.

In a third aspect, the invention provides a process for marking indicia on the surface of a tablet of compacted particulate washing composition, characterised in that the indicia are applied by a non-contact marking technique.

In a fourth aspect, the present invention provides a combination of at least one washing tablet of compacted particulate washing composition having indicia on at least one surface thereof and a closed packaging system enclosing the at least one tablet.

DETAILED DESCRIPTION OF THE INVENTION

According to the first aspect of the present invention, the indicia is/are on at least one surface of the tablet. Preferably, such indicia is/are present directly on and/or in the surface, i.e., not on a label which is applied to the surface but in direct contact with the tablet material at that surface. As will be explained in more detail hereinbelow, alternative methods of achieving this can involve various methods of contact or non-contact printing, or forming a surface relief feature, e.g. by etching.

TABLETS

Washing tablets of the present invention suitably have a mass of at least 8 g, preferably at least 10 g, more preferably at least 15 g, and may be up to 200 g or even 250 g, depending on the conditions of intended use; for example, it may be a unit dose for an average load in a fabric washing or dishwashing machine, or a unit dose of bathing salts for a bath. Preferably, a laundry tablet is in the range 10 to 60 g, more preferably 15 to 50 g. Preferably, a machine dish wash tablet is in the range 12 to 30 g, more preferably 15 to 27 g.

The tablets may be of any shape. However, for ease of packaging they are preferably blocks of substantially uniform cross-section, such as cylinders or cuboids. The overall density of a tablet preferably lies in a range from 1000 up to 2000 g/l, more preferably up to 1800 g/l, yet more preferably up to 1600 g/l. A laundry tablet may typically be in the range 1040 or 1050 up to 1300 g/l. A machine dish wash tablet density may typically be in the range of 1400 to 1600 g/l.

Tabletting

Tabletting entails compaction of a particulate washing composition. A variety of tabletting machinery is known, and can be used. Generally it will function by stamping a quantity of the particulate composition which is confined in a die.

Tabletting may be carried out at ambient temperature or at a temperature above ambient which may allow adequate strength to be achieved with less applied pressure during compaction. In order to carry out the tabletting at a temperature which is above ambient, the particulate composition is preferably supplied to the tabletting machinery at an elevated temperature. This will of course supply heat to the tabletting machinery, but the machinery may be heated in some other way also.

If any heat is supplied, it is envisaged that this will be supplied conventionally, such as by passing the particulate composition through an oven, rather than by any application of microwave energy.

Typically, the particulate washing composition is exposed to a compaction pressure (i.e. force per unit area) of least 2,500 $kN/m^2$, more preferably at least 4,000 $kN/m^2$. The maximum compaction pressure used in the manufacture of the washing tablets of the present invention is less than 200,000 $kN/m^2$, preferably less 175,000 $kN/m^2$, more preferably less than 150,000 $kN/m^2$, and most preferably less than 100,000 $kN/m^2$.

Tabletting can be carried out using elastomeric coated dies as described in WO98/46719 and WO98/46720 (Unilever).

Starting Material for Compaction

The particulate washing composition which is compacted may be a mixture of particles of individual ingredients, but more usually will comprise some particles which themselves contain a mixture of ingredients. Such particles containing a mixture of ingredients may be produced, for example, by a granulation process or spray-drying process, and may contain the surfactant and some or all of the detergency builder present in any composition. Such particles may be used alone or together with particles of single ingredients. Thus, a detergent tablet of this invention, or a discrete region of such a tablet, is a matrix of compacted particles.

Preferably the particulate composition has an average particle size in the range from 200 to 2000 $\mu$m, more preferably from 250 to 1400 $\mu$m. Fine particles, smaller than 180 $\mu$m or 200 $\mu$m may be eliminated by sieving before tabletting, if desired, although we have observed that this is not always essential.

While the starting particulate composition may in principle have any bulk density, the present invention is especially relevant to tablets made by compacting powders of relatively high bulk density. Thus the starting particulate composition may suitably have a bulk density of at least 400 g/l, preferably at least 500 g/l, and possibly at least 600 g/l.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Coatings

Tablets can also be coated either prior to being marked or after marking. Of course, if marked prior to being coated, the coating should be sufficiently transparent to allow the indicia to be readily observed. This can be achieved by using an appropriate coating or by etching out an area of the coating to reveal or create the indicia.

Suitable coatings for tablets are, for example, those described in WO98/24873 (Procter & Gamble).

WASHING COMPOSITIONS

The present invention applies to a variety of different types of washing tablets. In addition to laundry and machine dish wash tablets, it is envisaged that the present invention can be used to mark indicia on the surfaces of any compacted particulate washing composition. Suitable examples include bath salts, bath "bombs" and certain toilet blocks.

In a preferred embodiment, the washing tablets comprise a bleach component.

In another preferred embodiment, the washing tablets have a pH of at least 8.5, preferably at least 9, and more preferably at least 9.5. The pH may be as high as 11.

Reference herein to the pH of a washing tablet is to a 1% (w/v) solution of the tablet in demineralised water at 20° C.

Laundry Tablet Compositions

Surfactant

Laundry tablets generally contain one or more detergent surfactants. In a laundry washing composition, these preferably provide from 5 to 50 wt % of the overall tablet composition, more preferably from 8 or 9 up to 40 or 50 wt % of the overall composition. Surfactant may be anionic (soap or non-soap), cationic, zwitterionic, amphoteric, nonionic or a combination of these.

Anionic surfactant may be present in an amount from 0.5 to 50 wt %, preferably from 2 or 4 up to 30 or 40 wt % of the tablet composition.

Synthetic (i.e. non-soap) anionic surfactants are well known to those skilled in the art. Examples include alkylbenzene sulphonates, particularly sodium linear alkylbenzene sulphonates; olefin sulphonates; alkane sulphonates; dialkyl sulphosuccinates; and fatty acid ester sulphonates.

$C_{8-15}$ linear alkyl benzene sulphonates, and $C_{8-18}$, especially $C_{10-14}$, primary alkyl or alkenyl sulphates are commercially significant anionic surfactants, especially the sodium salts. Frequently, such linear alkyl benzene sulphonates or primary alkyl sulphates, or a mixture thereof will be the desired anionic surfactant and may provide 75 to 100 wt % of any anionic non-soap surfactant in the composition.

In some forms of this invention the amount of non-soap anionic surfactant lies in a range from 5 to 20 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened oils or fats.

Suitable nonionic surfactant compounds which may be used include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 5 to 20 moles of ethylene oxide per mole of alcohol.

In certain forms of this invention the amount of nonionic surfactant lies in a range from 4 to 40 wt %, preferably 4 or 5 to 30 wt % of the composition. Many nonionic surfactants are liquids. These may be absorbed onto particles of the composition, prior to compaction into tablets.

Detergency Builder

Laundry tablets will generally contain from 5, preferably from 15, up to 80 wt % of detergency builder. Preferably, they will contain from 15 to 60 wt % of detergency builder. This may be provided wholly by water soluble materials, or may be provided in large part or even entirely by water-insoluble material with water-softening properties. Water-insoluble detergency builder may be present at 5 to 80, preferably 5 to 60 wt % of the composition.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8–1.5\ Na_2O.Al_2O_3.0.8–6SiO_2.xH_2O$$

These materials contain some bound water (indicated as $xH_2O$) and are required to have a calcium ion exchange capacity of at least 50 mg CaO/g. The preferred sodium aluminosilicates contain 1.5–3.5 $SiO_2$ units (in the formula above).

Suitable crystalline sodium aluminosilicate ion-exchange detergency builders are described, for example, in GB 1429143 (Procter & Gamble). The preferred sodium aluminosilicates of this type are the well known commercially available zeolites A and X, the newer zeolite P described and claimed in EP 384070 (Unilever) and mixtures thereof.

Conceivably a water-insoluble detergency builder could be a layered sodium silicate as described in U.S. Pat. No. 4,664,839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used.

Water-soluble phosphate-containing inorganic detergency builders, include the alkali-metal orthophosphates, metaphosphates, pyrophosphates and polyphosphates. Specific examples of inorganic phosphate builders include sodium and potassium tripolyphosphates, orthophosphates and hexametaphosphates.

Non-phosphate water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates, aminopolycarboxylates such as nitrilotriacetates (NTA), ethylenediaminetetraacetate (EDTA) and iminodiacetates, alkyl- and alkenylmalonates and succinates; and sulphonated fatty acid salts. This list is not intended to be exhaustive.

Laundry tablet compositions preferably include polycarboxylate polymers, more especially polyacrylates and acrylic/maleic copolymers which can function as builders and also inhibit unwanted deposition onto fabric from the wash liquor.

Bleach System

Laundry tablets may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25 wt % of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A458398 and EP-A-549272. A bleach system may also include a bleach stabiliser (heavy metal sequestrant) such as ethylenediamine tetramethylene phosphonate and diethylenetriamine pentamethylene phosphonate.

Other Detergent Ingredients

Laundry tablets may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1 to about 3.0 wt % of the composition; and these granules or marumes present no problems with respect to compaction to form a tablet.

Laundry tablets may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino)stilbene disulphonate; and Tinopal CBS is disodium 2,2'-bis-(phenyl-styryl)disulphonate.

An antifoam material is advantageously included, especially if a laundry tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

It may also be desirable that a laundry tablet includes an amount of an alkali metal silicate, particularly sodium ortho-, meta- or disilicate. The presence of such alkali metal silicates at levels, for example, of 0.1 to 10 wt %, may be advantageous in providing protection against the corrosion of metal parts in washing machines, besides providing some measure of building and giving processing benefits in manufacture of the particulate material which is compacted into tablets. A composition for laundry washing will generally not contain more than 15 wt % silicate.

Further ingredients which can optionally be employed in laundry washing tablets include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

Machine Dish-Wash Tablet Compositions

Surfactant

Machine dish-wash tablets preferably contain a surfactant system comprising a surfactant selected from nonionic, anionic, catonic, ampholytic and zwitterionic surfactants and mixtures thereof.

Typically the surfactant is a low- to non-foaming nonionic surfactant, which includes any alkoxylated nonionic surface-active agent wherein the alkoxy moiety is selected from the group consisting of ethylene oxide, propylene oxide and mixtures thereof, is preferably used to improve the detergency without excessive foaming. However, an excessive proportion of nonionic surfactant should be avoided. Normally, an amount of 15 wt % or lower, preferably 10 wt % or lower, more preferably 7 wt % or lower, most preferably 5 wt % or lower and preferably 0.1 wt % or higher, more preferably 0.5 wt % or higher is quite sufficient, although higher level may be used.

Examples of suitable nonionic surfactants for use in the invention are the low- to non-foaming ethoxylated straight-chain alcohols of the Plurafac® RA series, supplied by the Eurane Company; of the Lutensol® LF series, supplied by the BasF Company and of the Triton® DF series, supplied by the Rohm & Haas Company.

Other surfactants such as anionic surfactant may be used but may require the additional presence of antifoam to surpress foaming. If an anionic surfactant is used it is advantageously present at levels of 2 wt % or below.

Detergency Builder

Machine dish-wash tablets generally contain a builder. The builder may be a phosphate or non-phosphate builder and typically is present at a level of from 1 to 90, preferably from 10 to 80, most preferably from 20 to 70 wt % of the composition.

Specific examples of water-soluble phosphate builders are the alkali metal tripolyphosphates, sodium, potassium and ammonium pyrophosphate, sodium and potassium orthophosphate, sodium polymeta/phosphate in which the degree of polymerization ranges from about 6 to 21, and salts of phytic acid. Sodium or potassium tripolyphosphate is most preferred.

Suitable examples of water-soluble non-phosphate inorganic builders include water-soluble alkali metal carbonates, bicarbonates, sesquicarbonates, borates, silicates, including layered silicates such as SKS-6 ex. Hoechst, metasilicates, and crystalline and amorphous aluminosilicates. Specific examples include sodium carbonate (with or without calcite seeds), potassium carbonate, sodium and potassium bicarbonates, silicates including layered silicates and zeolites.

Organic detergent builders can also be used as non-phosphate builders. Examples of organic builders include alkali metal citrates, succinates, malonates, fatty acid sulfonates, fatty acid carboxylates, nitrilotriacetates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062. Alkali metal citrates, nitrilotriacetates, oxydisuccinates, acrylate/maleate copolymers and acrylate/maleate/vinyl alcohol terpolymers are especially preferred non-phosphate builders.

Water Soluble Polymeric Polycarboxylic Compounds

A water-soluble polymeric polycarboxylic compound is advantageously present in machine dish wash compositions at a level of at least 0.1 wt %, more preferably at levels from 1 to 7 wt % of the total composition.

Preferably these compounds are homo- or co-polymers of polycarboxylic compounds, especially co-polymeric compounds in which the acid monomer comprises two or more carboxyl groups separated by not more than two carbon atoms. Salts of these materials can also be used.

Particularly preferred polymeric polycarboxylates are co-polymers derived from monomers of acrylic acid and maleic acid. The average molecular weight of these polymers in the acid form preferably ranges from 4,000 to 70,000.

Another type of polymeric polycarboxylic compounds suitable for use in the composition of the invention are homo-polymeric polycarboxylic acid compounds with acrylic acid as the monomeric unit. The average weight of such homo-polymers in the acid form preferably ranges from 1,000 to 100,000 particularly from 3,000 to 10,000.

Acrylic sulphonated polymers as described in EP 851 022 (Unilever) are also suitable.

Silicates

Machine dish wash tablets can optionally comprise alkali metal silicates. The alkali metal may provide pH adjusting capability and protection against corrosion of metals and against attack on dishware, including fine china and glassware benefits.

When silicates are present, the $SiO_2$ level should be from 1 to 25, preferably from 2 to 20, more preferably from 3 to 10%, based on the weight of the total composition. The ratio of $SiO_2$ to the alkali metal oxide ($M_2O$, where M=alkali metal) is typically from 1 to 3.5, preferably from 1.6 to 3, more preferably from 2 to 2.8. Preferably, the alkali metal silicate is hydrous, having from 15 to 25% water, more preferably from 17% to 20%.

The highly alkali metasilicates can in general be employed, although the less alkaline hydrous alkali metal silicates having a $SiO_2$:$M_2O$ ratio of from 2.0 to 2.4 are, as noted, greatly preferred. Anhydrous forms of the alkali metal silicates with a $SiO_2$:$M_2O$ ratio of 2.0 or more are also less preferred because they tend to be significantly less soluble than the hydrous alkali metal silicates having the same ratio.

Sodium and potassium, and especially sodium, silicates are preferred. While typical forms, i.e. powder and granular, of hydrous silicate particles are suitable, preferred silicate particles having a mean particle size between 300 and 900 microns and less than 40% smaller than 150 microns and less than 5% larger than 1700 microns. Particularly preferred is a silicate particle with a mean particle size between 400 and 700 microns with less than 20% smaller than 150 microns and less than 1% larger then 1700 microns. Compositions of the present invention having a pH of 9 or less preferably will be substantially free of alkali metal silicate.

Enzymes

Enzymes may be present in machine dish wash compositions. Examples of enzymes suitable for use in the cleaning compositions of this invention include lipases, peptidases, amylases (amylolytic enzymes) and others which degrade, alter or facilitate the degradation or alteration of biochemical soils and stains encountered in cleansing situations so as to remove more easily the soil or stain from the object being washed to make the soil or stain more removable in a subsequent cleansing step. Both degradation and alteration can improve soil removal.

Well-known and preferred examples of these enzymes are lipases, amylases and proteases. The enzymes most commonly used in machine dishwashing compositions are amylolytic enzymes. Preferably, the composition of the invention also contains a proteolytic enzyme. Enzymes may be present in a weight percentage amount of from 0.2 to 5 wt %. For amylolytic enzymes, the final composition will have amylolytic activity of from $10^2$ to $10^6$ Maltose units/kg. For proteolytic enzymes the final composition will have proteolytic enzyme activity of from $10^6$ to $10^9$ Glycine Units/kg.

Bleach Material

Bleach material is preferably present in machine dish was compositions. The bleach material may be a chlorine- or bromine-releasing agent or a peroxygen compound. Peroxygen based bleach materials are however preferred.

Organic peroxy acids or the precursors therefor are typically utilized as the bleach material. The peroxyacids usable in the present invention are solid and, preferably, substantially water-insoluble compounds. By "substantially water-insoluble" is meant herein a water-solubility of less than about 1 wt % at ambient temperature. In general, peroxyacids containing at least about 7 carbon atoms are sufficiently insoluble in water for use herein.

Inorganic peroxygen-generating compounds are also typically used as the bleaching material of the present invention. Examples of these materials are salts of monopersulphate, perborate monohydrate, perborate tetrahydrate, and percarbonate.

Monoperoxy acids useful herein include alkyl peroxy acids and aryl peroxyacids such as peroxybenzoic acid and ring-substituted peroxybenzoic acids (e.g. peroxy-alpha-naphthoic acid); aliphatic and substituted aliphatic monoperoxy acids (e.g. peroxylauric acid and peroxystearic acid); and phthaloyl amido peroxy caproic acid (PAP).

Typical diperoxy acids useful herein include alkyl diperoxy acids and aryldiperoxy acids, such as 1,12-di-peroxydodecanedioic acid (DPDA); 1,9-diperoxyazelaic acid, diperoxybrassylic acid, diperoxysebacic acid and diperoxyisophthalic acid; and 2-decyldiperoxybutane-1,4-dioic acid.

Peroxyacid bleach precursors are well known in the art. As non-limiting examples can be named N,N,N',N'-tetraacetyl ethylene diamine (TAED), sodium nonanoyloxybenzene sulphonate (SNOBS), sodium benzoyloxybenzene sulphonate (SBOBS) and the cationic peroxyacid precursor (SPCC) as described in U.S. Pat. No. 4,751,015.

If desirably a bleach catalyst, such as the manganese complex, e.g. Mn-Me TACN, as described in EP-A-0458397, or the sulphonimines of U.S. Pat. No. 5,041,232 and U.S. Pat. No. 5,047,163, is to be incorporated, this may be presented in the form of a second encapsulate separately from the bleach capsule or granule. Cobalt catalysts can also be used.

Among suitable reactive chlorine- or bromine-oxidizing materials are heterocyclic N-bromo and N-chloro imides such as trichloroisocyanuric, tribromoisocyanuric, dibromoisocyanuric and dichloroisocyanuric acids, and salts thereof with water-solubilizing cations such as potassium and sodium. Hydantoin compounds such as 1,3-dichloro-5,5-dimethyl-hydantoin are also quite suitable.

Particulate, water-soluble anhydrous inorganic salts are likewise suitable for use herein such as lithium, sodium or calcium hypochlorite and hypobromite. Chlorinated trisodium phosphate and chloroisocyanurates are also suitable bleaching materials.

Encapsulation techniques are known for both peroxygen and chlorine bleaches, e.g. as described in U.S. Pat. No. 4,126,573, U.S. Pat. No. 4,327,151, U.S. Pat. No. 3,983,254, U.S. Pat. No. 4,279,764, U.S. Pat. No. 3,036,013 and EP-A-0,436,971 and EP-A-0,510,761. However, encapsulation techniques are particularly useful when using halogen based bleaching systems.

Chlorine bleaches, the compositions of the invention may comprise from about 0.5 to about 3% avCl (available Chlorine). For peroxygen bleaching agents a suitable range are also from 0.5 to 3% avO (available Oxygen). Preferably, the amount of bleach material in the wash liquor is at least $12.5\times10^{-4}$ and at most 0.03% avO by weight of the liquor.

Chelating Agent

A chelating agent may be present in a machine dish wash composition. If present, it is preferable if the level of chelating agent is from 0.5 to 3 wt % of the total composition.

Preferred chelating agents include organic phosphonates, amino carboxylates, polyfunctionally-substituted compounds, and mixtures thereof.

Particularly preferred chelating agents are organic phosphonates such as $^{\alpha}$-hydroxy-2 phenyl ethyl diphosphonate, ethylene diphosphonate, hydroxy 1,1-hexylidene, vinylidene 1,1 diphosphonate, 1,2 dihydroxyethane 1,1 diphosphonate and hydroxy-ethylene 1,1 diphosphonate. Most preferred is hydroxy-ethylene 1,1 diphosphonate.

Anti-Tarnishing Agents

Anti-tarnishing agents such as benzutriazole and those described in EP 723 577 (Unilever) may also be included.

Optional Ingredients

Optional ingredients are, for example, buffering agents, reducing agents, e.g., borates, alkali metal hydroxide and the well-known enzyme stabilisers such as the polyalcohols, e.g. glycerol and borax; anti-scaling agents; crystal-growth inhibitors, threshold agents; thickening agents; perfumes and dyestuffs and the like.

Reducing agents may e.g. be used to prevent the appearance of an enzyme-deactivating concentration of oxidant bleach compound. Suitable agents include reducing sulphuroxy acids and salts thereof. Most preferred for reasons of availability, low cost, and high performance are the alkali metal and ammonium salts of sulphuroxy acids including ammonium sulphite ($(NH_4)_2SO_3$), sodium sulphite ($Na_2SO_3$), sodium bisulphite ($NaHSO_3$), sodium metabisulphite ($Na_2S_2O_3$), potassium metabisulphite ($K_2S_2O_5$), lithium hydrosulphite ($Li_2S_2O_4$), etc., sodium sulphite being particularly preferred. Another useful reducing agent, though not particularly preferred for reasons of cost, is ascorbic acid. The amount of reducing agents to be used may vary from case to case depending on the type of bleach and the form it is in, but normally a range of about 0.01 to about 1.0, preferably from about 0.02 to about 0.5 wt % will be sufficient.

Disintegration Aids

In a preferred embodiment, washing tablets of this invention contain ingredients which promote disintegration of the tablets in their washing application. For example, the tablets can contain ingredients which lead to the generation of a gas upon contact with water (i.e. generate an effervescent effect) such as citric acid and sodium bicarbonate. Alternatively or in addition, the tablets can contain water-swellable polymeric material and/or disintegration-promoting particles as described in WO98/55582, WO98/55583 and WO98/55590 (Unilever).

MARKING AND INDICIA

The washing tablets of the present invention have indicia on their surface(s). These indicia can take numerous forms. They can be words, symbols, pictures, patterns, logos, combinations of these, or simply zones of colour. The manufacturers name, the brand name and the brand type are typical examples of what can be marked on the tablet. Furthermore, instructions for use and/or safety instructions can be marked on the tablets.

The provision of written or pictorial instructions for use and/or safety instructions on the surface of washing tablets is new and has not previously been reported. Using the process of the present invention this is now achievable. In particular, the ability to be able to place safety instructions on washing tablets may be important. Some compositions, especially machine dish wash compositions, may contain ingredients which can irritate both through touch and breathing, although this does not generally apply to laundry tablets.

In a preferred embodiment, the indicia are of a contrasting colour to the surface of the washing tablet. In a preferred embodiment, the contrasting colour is provided by a colourant comprising a pigment and/or dye.

As mentioned earlier, tablets can be given the appearance of layering by marking the formed tablet with a zone of colour. This provides considerable cost savings over current methods of producing "layered" tablets. Of course, more than one colour can be applied by the process of the invention and intricate patterns if desired.

Colourants

Colourants can be either a solution or a suspension of a colouring agent. As used herein the term ink is taken to mean a solution of a dye or a suspension of a pigment in a carrier vehicle. The colourant is therefore preferably an ink. Inks are prepared by suspending or dissolving the dye or pigment in a liquid, volatile carrier such as water, alcohol, or mixture thereof. Suitable alcohols include lower alkanols such as methanol, isopropanol, butanol, isobutanol or ethanol, and polyols such as glycol, polyethyleneglycol or glycerol.

For better fixing on the surfaces, an adhesive may be employed. Suitable examples include sugar-based adhesives such as methyl cellulose, hydroxypropyl methylcellulose or hydroxypropyl ethylcellulose phthalate.

Water-based inks contain from 70 to 90% water depending on the nature of the ink. However, because of the small droplet size, the solvent evaporates rapidly and does not affect the structure of the washing tablet.

Clearly, the final usage of the washing tablet has to be taken into consideration when selecting the nature of the ink and the particular colorant being used. If the tablet is to be used for washing laundry, then obviously a colorant which is liable to damage clothing in the wash environment is unsuitable.

Colourants which are pH stable, especially those which are alkali-stable, are particularly suited to the present invention. In a preferred embodiment inks comprising alkali-stable dyes are used to mark washing tablets with a alkaline pH, e.g. laundry and machine dish wash tablets. An example of an alkali-stable dye is Solar Yellow GB 300% C119555.

Pigments tend not to be effected by high or low pH values to the same degree as many dyes. Thus in another preferred embodiment, inks comprising pigments are used to mark washing tablets with a alkaline pH, e.g. laundry and machine dish wash tablets. Suitable pigments, for example, include Flexo Yellow GRX, Mostryl Blue, Tinofil Carmine and Kenalake Green.

Furthermore, pigments are typically less likely to be effected by bleaches than dye-based colourants.

Marking Process

Tablets can be marked on their surface using a contact or non-contact marking technique.

Contact Marking

Surprisingly, we have found that washing tablets can be marked with indicia, such as for example a brand name, by contact printing. This can be achieved using either a dye based ink or a pigment based ink.

We have found that the problems associated with the uneven surface and relatively low strength of the washing tablets can to a large extent be overcome by using an appropriately elastic die.

Thus, in a preferred embodiment, the device for contact printing the washing tablet comprises a die, the die having at least one tablet "stamping" surface wherein the tablet stamping surface comprises, at least in part, an elastomeric material. Preferably, any part of the tablet stamping surface which is intended to come into contact with the tablet surface, i.e. those parts of the die which define and impart the marking (e.g. logo), comprise an elastomeric material.

Suitable dies may comprise an elastomeric portion and a non-elastomeric portion. If this is the case, the elastomeric portion must be the one that contacts the surface of the washing tablet. In a preferred embodiment, the elastomeric portion comprises one or more coatings which are adhered or attached to a non-elastomeric portion.

By "elastomeric" according to the invention is meant a material as defined in ISO (International Standard Organisation) 1382 as an "elastomer", or a "rubber". Also included in the definition of "elastomeric" materials according to the invention are thermoplastic elastomers and copolymers and blends of elastomers, thermoplastic elastomers and rubbers.

Elastomers are defined as polymers with long flexible chains, independent in the raw material and transformed via vulcanising or cross-linking agents which introduce cross-links and form a cross-linked network structure. The network structure retains the movement of the macro-molecular chain molecules and as a result returns rapidly to approximately its initial dimension and shape after deformation by a force and release of the force.

With increasing temperature an elastomer goes through a rubbery phase after softening and retains its elasticity and elastic modulus until its decomposition temperature is reached.

Thermoplastic elastomers consist of amorphous and crystalline phases. The amorphous phase has a softening range below ambient temperature and thus acts as an elastic spring whilst the crystalline segments whose softening range is above ambient temperature, act as cross-linking sites Preferably the elastomeric material according to the invention is selected from those classes described in American Society for Testing and Materials D1418 which include:

1. Unsaturated carbon chain elastomers (R Class) including natural rubbers e.g. Standard Malaysian Rubber; butadiene e.g. "BUNA" type ex Bunawerke Huls; and butadiene acrylonitrile copolymer e.g. "Perbunan" ex Bayer.
2. Saturated carbon chain elastomers (M Class) including ethylene-propylene types e.g. "Nordel" ex DuPont and fluorine containing types e.g. "Viton" ex DuPont.
3. Substituted silicone elastomers (Q Class) including liquid silicone rubbers e.g. Silastic 9050/50 P (A+B) ex Dow Corning.
4. Elastomers containing carbon, nitrogen and oxygen in the polymer chain (U Class) including polyurethanes e.g. polyurethanes ex Belzona.

Suitable elastomeric materials include silicone rubbers such as Silastic 9050/50 P A+B (ex Dow Corning) which after curing has a modulus of elasticity about 2–3 MPa; and polyurethanes, for example Belzona PU2221, as hereinafter defined, which after curing has a modulus of elasticity of about 9 MPa, and Belzona 2131 (MP Fluid Elastomer), a 2 part product based on a diphenylmethane 4,4'-diisocyanate (MDI) system with a phenylmercuric neodecanoate catalyst.

If being used to coat a die surface, the "elastomeric" material, as hereinbefore defined, may be pretreated, such as by forming a solution of a commercially available elastomer, prior to it being applied as a coating on the die surface. The elastomers, rubbers, and copolymers and blends thereof are generally cured or cross-linked, in-situ on the die surface. For example, the components including the base elastomeric material, cross-linking agents and other materials such as accelerators may be mixed prior to application as a coating. Once applied to the die the coatings are cured in-situ. This maybe aided by the application of heat or other accelerating processes, for example pressure; radiation or UV light.

In some cases, materials may be dissolved with an appropriate solvent, applied to the die and the solvent subsequently driven off.

In the case of themoplastic materials, they can be heated to melt condition applied to the die, cooled and resolidified.

The modulus of elasticity of the surface of the die which comes into contact with the surface of the washing tablet may be measured by recording the force required to indent the elastomeric material as a function of the indentation depth. Typically an indentor with a spherical tip may be employed and the slope, s, of the force as a function of the indentation depth to the power 3/2 is determined. The indentation depth is the movement of an indentor into the elastomeric material after it first contacts the surface of the material. In general, it is necessary to correct the measured indentation depth for the compliance of the measurement apparatus. That is, the actual indentation depth, d, is related to the measured apparent value d' by the following expression $$d=d'-(F.C)$$

where F is the indentation force. The compliance C is determined by compressing the indentor against a rigid surface and recording the apparent displacement as a function of the applied force which has a slope equal to C. The modulus of elasticity E is calculated from the following expression $$E=\frac{3}{4}\cdot s\cdot\frac{1}{\sqrt{R}}\cdot(1-b^2)$$

where $s=F/d^{3/2}$, R is the radius of the spherical tip of the indentor and b is the Poisson's ratio of the elastomeric material which is equal to about 0.5 for elastomers.

Under certain conditions to be described hereafter, the above indentation method may give falsely large values of the elastic modulus due to the influence of the rigid material to which the elastomeric material is attached. This may be a particular problem when the elastomeric material has been applied as a thin coating. In order to safely avoid this problem it is necessary to ensure that the contact radius of the indentor with the elastomeric material does not exceed about 1/10 of the thickness of the material, e.g. the coating. The contact radius, a, is related to the indentation depth by the following expression $$a=\sqrt{dR}$$

If the elastomeric material is a coating, it is preferred that it is at least 200 $\mu$m, more preferably at least 500 $\mu$m, yet more preferably 1 mm thick. Of course, it will be understood that thinner coatings may still provide benefits, for example in the case where tablets with relatively smooth surfaces are being marked.

Preferably, the surface of the die which comes into contact with the surface of the washing tablet has a modulus of elasticity of less than $5\times10^7$ $Nm^{-2}$, preferably less than $1\times10^7$ $Nm^{-2}$. The modulus of elasticity is preferably greater than $1\times10^5$ $Nm^{-2}$, more preferably greater than $1\times10^6$ $Nm^{-2}$, and yet more preferably greater than $3\times10^6$ $Nm^{-2}$. Preferably, the modulus of elasticity is in the range $5\times10^6$ to $1\times10^7$ $Nm^{-2}$.

Non-Contact Marking

In another preferred embodiment, tablets are marked with indicia on their surface using a non-contact marking technique. Using such techniques, tablets can be marked on any area of their surface which is exposed, i.e. which is not in immediate or very near contact with any supporting or conveying means. This is not possible with contact-printing techniques since they require the tablet to be resilient to a certain degree to the contact force in order for a good print mark to be imparted.

Any appropriate non-contact technique may be used as will be apparent to the person skilled in the art. However, two techniques are particularly preferred.

Ink-Jet Printing

Printing by means of an ink-jet process is well-known in the art in relation to printing on paper and the like.

In the present invention, ink is dotted by means of an ink-jet process onto the surface of a washing tablet so that, as a result of controlled guidance and/or deflection, multiple dots of ink are applied on the surface of the tablet so as to form an indicia.

The ink-jet printer produces an image by propelling from a printer head a stream of fine droplets which impact on the surface of the tablet to be marked, preferably as the tablet is conveyed past the head. The droplets are controlled, typically electrically, so that they are deposited in a controlled array and the tablet surface is thereby marked with a desired indicia. Several different types of ink-jet printers are available, the major difference being in the method of propelling the ink onto the surface to be marked.

Each small droplet of ink produces a tiny dot on the tablet surface. More often than not, multiple droplets are applied at the same position by applying the ink in pulses. This allows the colour intensity of a dot to be built up without increasing the size of the dot to a great extent and thus losing definition. By applying dots in close proximity to one another, a readily visible image is built up.

Laser-Marking

Laser marking is achieved by removing material from the tablet surface to be marked or by changing the surface of the tablet. The most important consideration is how well the material being marked absorbs the laser beam. This can determine the type of laser beam used as different wavelengths can have different absorption characteristics.

For optimum results the laser beam should be absorbed in the very outer surface of the tablet so that sufficient energy density is produced to modify the surface by one of the following three processes:

i) Coating removal: The laser is absorbed by the surface coating and vaporises it to reveal a contrasting substrate. For example, a tablet surface may be coloured using an ink-jet process and part of the colorant subsequently removed using a laser.

ii) Etching: The laser vaporises material from the surface of the tablet without producing any colour change. The resulting mark looks similar to an embossed print.

iii) Thermochemical: The laser changes the material by heating it to a sufficiently high temperature to break molecular bonds. The new material formed by this process may have a different colour thus producing a discernible mark.

The first two processes both rely of removal of material form the surface of the tablet by vaporisation. In this sense they are both a form of etching. Any suitable mode of etching can be used in the present invention as will be obvious to the skilled man. Three examples of modes of etching are as follows:

i) The laser beam can be passed through a mask or stencil precut with the desired marking. The laser beam, which forms an image of the mask, is then directed onto the surface of the tablet to be marked. Suitable lasers include those which have been designed for industrial marking applications and which produce short, powerful pulses of light energy, preferably in the infrared range, e.g. carbon dioxide and helium-neon lasers. Preferably, the pulsed lasers are used at a low pulse energy but high repetition rate in order to achieve a high, industrially viable marking speed.

ii) The tablet can be moved past a plurality of pulsed laser beams arranged along a single line, thus creating a dot matrix pattern on the surface of the tablet.

iii) The laser beam can be scanned over the surface of the tablet using rapidly rotating, computer-controlled mirrors. Suitable lasers for use in this mode are continuous wave carbon dioxide lasers.

The vaporised portion of the tablet surfaces can be removed by suction using well-known devices in the art.

Tablet Production Process

The washing tablets are preferably produced by a continuous process which includes the steps of compaction, conveyance and packaging.

In a preferred embodiment, the marking process and apparatus are fully automated. Preferably, they are also controlled via a computer.

Ideally, the marking process and apparatus are fully integrated into the process for washing tablet manufacture, being positioned somewhere between the compaction and packaging steps. Preferably, marking takes place during the conveying step.

Preferably, the compaction, conveyance, marking and packaging steps are controlled through an integrated control system, preferably by means of a computer.

Conveyance

Tablets are conveyed by an appropriate conveying means from the compaction step to the packaging step. A typical conveying means comprises a conveyor belt, which may optionally have means for holding the washing tablets in position, particularly if the tablets are of an unusual shape.

The marking or printing equipment will preferably be positioned along the conveying means, preferably above and/or to the side of the passing washing tablets. Preferably the marking or printing equipment is equipped with a sensor to detect when a tablet is passing it; typically underneath and/or to the side of it. Once the leading edge of a tablet is detected, the marking or printing device is triggered to mark the tablet.

Of course, if the tablets are uniformly spaced and are being conveyed at a constant rate, it is not essential to have a sensor to detect the leading edge of each tablet; the marking or printing equipment could simply be triggered at set time intervals.

Packaging

The invention provides a combination of at least one tablet of compacted particulate washing composition marked on its surface with indicia and a closed packaging system enclosing the at least one tablet.

Preferably the packaging system is an easy to open system in which the tablet or tablets may be easily articulated while still within the packaging. Furthermore, the packaging system will preferably include means for, or be designed to facilitate, easy dispensing of the tablet therefrom, preferably without the need for the user to handle or otherwise physically contact the tablet composition.

One way of achieving this is to package one or more washing tablets in a flow wrap packaging system whereby, once the system has been opened, the tablets may simply be squeezed out of the package and directly into a dispensing device or apparatus of application. Further, the seals on the flow wrap may be sufficiently weakened at strategic points to allow such a squeezing or forcing action to open the flow wrap package.

An alternative method which is envisaged is the provision of a cylindrical container having an opening at one end thereof and a reclosable lid means for the opening whereby dispensing of the washing tablets is effected by simply removing the lid and inverting the container until a tablet falls out into a dispensing device.

Preferably, the packaging system has a moisture vapour transmission rate (MVTR) of less than 20 $g/m^2/24$ hours. Ideally, the MVTR is approximately 5 $g/m^2/24$ hours.

The packaging system will advantageously have some permeability to oxygen. Preferably, this will not be greater than 2000 $cm^3/m^3/24$ hours.

Typically, the packaging system comprises a material having a bulk density of less than 40 $g/m^2$.

Preferably, the packaging system comprises a polymeric film, preferably an oriented polypropylene film. Suitable films are sold under the trademark BICOR. Alternatively, the packaging system may comprise a PET/PE laminate, preferably having a thickness of approximately 12 micron PET/40 micron PE.

In a preferred embodiment of the invention the washing tablet is wrapped in a flow-wrap sealed polymer-based packaging system such as those described above. Ideally, the flow-wrap is heat sealed at each end along a longitudinal seam.

In another embodiment of the invention, the packaging system can comprise a water soluble wrapping, and preferably a thermoformed water soluble packaging material. Such materials are well known in the art.

In a preferred embodiment, the combination according to the invention will ideally comprise two washing tablets wrapped in a flow-wrap packaging system.

The packaging system is preferably at least partially transparent. In a preferred embodiment, if the tablets are marked with words or symbols indicative of the origin of the tablet (e.g. the manufacturer's name, the brand, etc.) or with safety instructions or instructions for use, the packaging is at least sufficiently transparent for these markings to be clearly visible to the eye.

The invention is now further illustrated by the following non-limiting examples:

EXAMPLES

Example 1

In Example 1, a conventional laundry tablet was marked using an ink-jet printer. The tablets were Persil Non-Bio for the UK market. These tablets were cylindrical in shape, the height being about half the circumference. The tablets were marked with the logo "Persil" on an end surface.

The ink-jet printer was a Domino A300 series. The ink was Domino 432-RD food grade ink. The following machine settings were used: 16, 21 and 32 drops using the 75 $\mu$m nozzle. The speed of the machine at each setting was 68, 29 and 13 m/min, respectively.

The logo in each case was well-defined and remained so for several weeks.

Example 2

The following pigments/dyes were used to contact print a design on Persil Non-Bio laundry tablets for the UK market:

Solar yellow BG 300% C119555 (dye)

Flexo Yellow GRX (pigment)

Monstryl Blue (pigment)

Tinofil Carmine (pigment)

Kenalake Green (pigment)

Tablets were marked by coating the die/stamp with dye or pigment and then pressing the dye onto the surface of the tablet with a small amount of pressure.

Half the tablets were stored for 6 weeks in natural light; half in a dark cupboard. Storage was at ambient temperatures. The colours showed no degradation over this timescale.

What is claimed is:

1. A process for marking indicia on the surface of a tablet of compacted particulate washing composition, characterised in that the indicia are applied by a non-contact marking technique, in which the non-contact marking technique comprises ink-jet printing.

2. A process for marking indicia on the surface of a tablet of compacted particulate washing composition, characterised in that the indicia are applied by a non-contact marking technique, in which the non-contact marking technique comprises laser marking.

* * * * *